US009211733B2

(12) United States Patent
Ide et al.

(10) Patent No.: US 9,211,733 B2
(45) Date of Patent: Dec. 15, 2015

(54) LIQUID EJECTING APPARATUS

(71) Applicant: SEIKO EPSON CORPORATION, Tokyo (JP)

(72) Inventors: Mitsutaka Ide, Shiojiri (JP); Tomoya Murotani, Shiojiri (JP); Hiroyuki Kobayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/666,827

(22) Filed: Mar. 24, 2015

(65) Prior Publication Data

US 2015/0273886 A1 Oct. 1, 2015

(30) Foreign Application Priority Data

Mar. 27, 2014 (JP) ..... 2014-066992

(51) Int. Cl.

| | |
|---|---|
| ***B41J 29/393*** | (2006.01) |
| ***B41J 11/00*** | (2006.01) |
| ***B41J 11/42*** | (2006.01) |
| ***B41J 13/00*** | (2006.01) |
| ***B41J 15/00*** | (2006.01) |
| ***B41J 15/04*** | (2006.01) |

(52) U.S. Cl.

CPC ..... *B41J 11/0085* (2013.01); *B41J 11/42* (2013.01); *B41J 13/0027* (2013.01); *B41J 15/00* (2013.01); *B41J 15/048* (2013.01)

(58) Field of Classification Search

CPC ..... B41J 11/0085; B41J 15/048; B41J 15/00; B41J 13/0027; B41J 11/42

See application file for complete search history.

(56) References Cited

U.S. PATENT DOCUMENTS

| | | | | |
|---|---|---|---|---|
| 5,883,646 | A * | 3/1999 | Beauchamp | 347/19 |
| 8,777,400 | B2 | 7/2014 | Yamamoto et al. | |
| 8,864,271 | B2 | 10/2014 | Abe | |
| 2014/0132687 | A1 | 5/2014 | Abe et al. | |

FOREIGN PATENT DOCUMENTS

| | | |
|---|---|---|
| JP | 2013-119439 | 6/2013 |
| JP | 2013-163283 | 8/2013 |
| JP | 2014-094500 | 5/2014 |

* cited by examiner

*Primary Examiner* — Julian Huffman
(74) *Attorney, Agent, or Firm* — Workman Nydegger

(57) ABSTRACT

A printer includes a transportation unit that transports a continuous form paper, an ejecting unit that ejects ink onto the continuous form paper, a continuous form paper supporting unit that includes a supporting surface capable of supporting the continuous form paper so as to be opposite to the ejecting unit, a light-transmitting glass that is mounted at a position in the medium supporting unit which faces the continuous form paper transported by the transportation unit, an imaging unit that captures an image of the continuous form paper which passes over a front surface of the light-transmitting glass, a control unit that controls a transportation amount of the continuous form paper based on the image captured by the imaging unit, and a suction fan that generates an airflow onto the front surface of the light-transmitting glass. An antistatic film is formed on the front surface of the light-transmitting glass.

5 Claims, 6 Drawing Sheets

LIQUID EJECTING APPARATUS

CROSS-REFERENCE TO RELATED APPLICATIONS

The present application claims priority to Japanese Patent Application No. 2014-066992 filed on Mar. 27, 2014, which is hereby incorporated by reference in its entirety.

BACKGROUND

1. Technical Field

Embodiments of the present invention relate to a liquid ejecting apparatus including an imaging unit.

2. Related Art

As a liquid ejecting apparatus ejecting liquid such as ink from an ejecting unit onto a medium such as paper, a liquid ejecting apparatus, in which a medium supporting unit supporting a medium is provided with an imaging unit, a texture on a rear surface of the medium that passes over the medium supporting member is imaged by the imaging unit, and a transportation amount of a medium is detected on the basis of the imaged image, has been known. In the liquid ejecting apparatus, an opening portion for irradiating a rear surface of the medium with light from the imaging unit is provided on a supporting surface of the medium supporting unit. At the opening portion, a light-transmitting member is disposed which suppresses foreign matter such as dust from entering into the imaging unit while allowing the light to be transmitted (for example, refer to JP-A-2013-119439).

However, the light-transmitting member may be friction-charged by static electricity generated due to friction between paper being transported and the light-transmitting member, for example. Foreign matter such as paper powder which is powder-form fiber peeled off from a front surface of paper, and dust may be present on the inside of the liquid ejecting apparatus, for example, on the medium supporting unit and the peripheries thereof. For this reason, the foreign matter may be drawn to the front surface of the light-transmitting member by electrostatic induction. When the foreign matter drawn to the front surface of the light-transmitting member is attached to the front surface of the light-transmitting member, light from the imaging unit is reflected by the foreign matter. As a result, the textures of the foreign matter are imaged. Thus, there is a concern that the accuracy with which the textures of the rear surface of the paper are imaged may deteriorate.

SUMMARY

An advantage of some aspects of the invention is to provide a liquid ejecting apparatus that can suppress an imaging accuracy of a medium from deteriorating.

Hereinafter, embodiments of the invention and operation effects thereof will be described.

According to an aspect of the invention, a liquid ejecting apparatus is disclosed. The liquid ejecting apparatus may include a transportation unit that transports a medium, an ejecting unit that ejects liquid onto the medium that is transported by the transportation unit, a medium supporting unit that includes a supporting surface capable of supporting the medium transported by the transportation unit so as to be opposite to the ejecting unit, a light-transmitting member that is mounted at a position in the medium supporting unit where the light-transmitting member faces the medium transported by the transportation unit, an imaging unit that captures an image of the medium which passes over a front surface of the light-transmitting member, a control unit that controls a transportation amount of the medium by the transportation unit based on the image captured by the imaging unit, and an airflow generating unit that generates airflow onto or over the front surface of the light-transmitting member. An antistatic film may be formed on the front surface of the light-transmitting member.

In one example, because the antistatic film is formed on the front surface of the light-transmitting member, it is difficult for the light-transmitting member to be or to become electrically charged. Therefore, foreign matter such as paper powder and dust are not easily drawn or attracted to the front surface of the light-transmitting member by electrostatic induction. As a result, the foreign matter is not easily attached to the front surface of the light-transmitting member. In addition, in a case in which the foreign matter is attached to the front surface of the light-transmitting member due to the electrostatic induction or for reasons other than electrostatic induction, the foreign matter attached on the front surface of the light-transmitting member may be removed by the airflow generated from the airflow generating unit. As described above, the foreign matter does not easily exist or remain on the front surface of the light-transmitting member. Thus deterioration in the accuracy with which the medium is imaged by the imaging unit is suppressed.

In one example of the liquid ejecting apparatus, the antistatic film may be formed on a predetermined region that includes at least an irradiation region irradiated with light by the imaging unit on the front surface of the light-transmitting member. The light-transmitting member may be grounded by mounting or connecting a conductive member on or to the predetermined region.

In one example, the light-transmitting member is grounded by the conductive member that is mounted on or connected to the predetermined region including at least the irradiation region. Thus charging of the irradiation region is further suppressed. For this reason, it is possible to suppress the deterioration of the imaging accuracy of the medium by the imaging unit.

In one example of the liquid ejecting apparatus, the light-transmitting member includes a first surface and a second surface. The second surface is a surface opposite to the first surface. Either the first surface or the second surface corresponds to the front surface, and the antistatic film may be formed or disposed on both of the first and second surfaces.

Out of the first surface and the second surface of the light-transmitting member, the front surface, which is a surface facing the medium, is determined when a manufacturer imposes or installs the light-transmitting member on or in the medium supporting unit. In the liquid ejecting apparatus, because the antistatic films are formed on both of the first and second surfaces of the light-transmitting member, the manufacturer can select either of the first and second surfaces of the light-transmitting member as the front surface when imposing or installing the light-transmitting member on or in the medium supporting unit. For this reason, work efficiency can be increased when imposing or installing the light-transmitting member on or in the medium supporting unit.

In the liquid ejecting apparatus, the front surface of the light-transmitting member may be positioned further apart from the ejecting unit than the supporting surface. In one example, the light-transmitting member is recessed in the supporting surface and does not come into contact with the medium as the medium is transported.

In one example, the medium transported by the transportation unit is supported by the supporting surface of the medium supporting unit. The medium supporting unit may be closer to the ejecting unit than to the front surface of the light-transmitting member. Thus, it is difficult for the rear surface of the medium and the front surface of the light-transmitting member to come into direct contact with each other. Therefore, the light-transmitting member is not easily friction-charged or is not easily charged by friction.

In one example of the liquid ejecting apparatus, the medium supporting unit includes suction holes which are capable of sucking the medium supported by the supporting surface in response to driving the airflow generating unit. The suction holes are formed at a position in the medium supporting unit such that the airflow can be generated along the front surface of or over the light-transmitting member in response to driving the airflow generating unit.

In one example, the foreign matter existing or located on the front surface of the light-transmitting member may be easily removed through the suction hole included in the medium supporting unit by the airflow generated by the airflow generating unit.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an ink jet type printer, which is an embodiment of a liquid ejecting apparatus, will be described with reference to drawings.

Figure 1A:
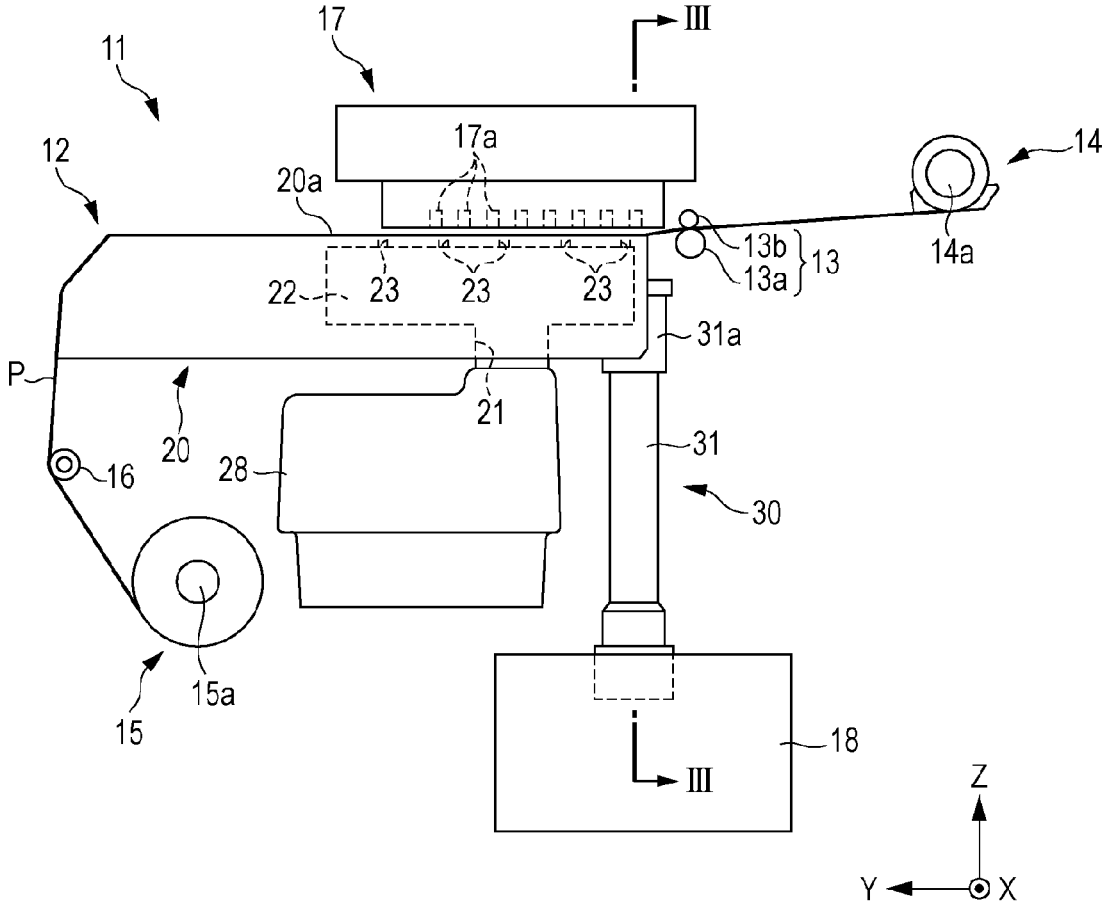
FIG. 1A is a schematic configuration view of an example of an ink jet type printer.

FIG. 1A illustrates an ink jet type printer, which is an example of a liquid ejecting apparatus. As illustrated in FIG. 1A, the ink jet type printer (hereinafter, referred to as a "printer 11") includes a transportation device 12 that transports a long sheet-shape continuous form paper P, which is an example of a medium. The printer 11 includes an ejecting unit 17 that performs printing by ejecting ink onto the continuous form paper P being transported by the transportation device 12. In addition, the printer 11 includes a control unit 18 that controls the transportation device 12 and the ejecting unit 17.

The transportation device 12 includes a feeding portion 14 feeding the continuous form paper P, and a winding portion 15 winding the continuous form paper P which is fed from the feeding portion 14 and is printed using the ejecting unit 17. In FIG. 1A, the feeding portion 14 is disposed on the right side, which is the upstream side of the continuous form paper P in a transportation direction Y (left direction of FIG. 1A). The winding portion 15 is disposed on the left side which is the downstream side of the transportation direction.

The ejecting unit 17 is disposed between the feeding portion 14 and the winding portion 15 so as to be opposite to a transportation path of the continuous form paper P. A plurality of nozzles 17*a* for ejecting ink onto the continuous form paper P are formed on the surface of the ejecting unit 17 facing the transportation path of the continuous form paper P.

In the printer 11, the medium supporting unit 20 supporting the continuous form paper P is disposed at a position opposite to the ejecting unit 17 with the transportation path of the continuous form paper P pinched therebetween. The paper P is thus transported between the medium supporting unit 20 and the ejecting unit 17. The medium supporting unit 20 has a bottomed quadrangular box shape in one example. An entrance portion 21 is formed on a lower surface side of the medium supporting unit 20. The lower surface side is opposite to the ejecting unit 17 side.

A suction fan 28 is an example of an airflow generating unit. The suction fan 28 is positioned to suck air in an inner space 22 of the medium supporting unit 20 and is mounted so as to block the entrance portion 21 on the lower surface of the medium supporting unit 20. The suction fan 28 is connected with the entrance portion 21 such that air can be sucked from the inner space 22.

A supporting surface 20*a* supporting the continuous form paper P being transported is horizontally formed at a position where the medium supporting unit 20 faces the ejecting unit 17. A plurality of suction holes 23 for adsorbing or suctioning the continuous form paper P to the supporting surface 20*a* is formed on or in the medium supporting unit 20. Each suction hole 23 communicates with the inner space 22 of the medium supporting unit 20. The suction fan 28 sucks air by being rotationally driven, using the entrance portion 21 as an intake. Therefore, a negative pressure is formed in a space between the continuous form paper P and the medium supporting unit 20 through the inner space 22 and the suction hole 23. Accordingly, a suction force for adsorbing or suctioning the continuous form paper P to the supporting surface 20*a* may be applied to the continuous form paper P.

An imaging unit 30 for detecting a transportation amount of the continuous form paper P in a non-contact manner is mounted on the lower portion of the medium supporting unit 20. The imaging unit 30 images a texture of the rear surface (surface not to be printed) of the continuous form paper P and sends the image to the control unit 18 mounted on the lower portion of the imaging unit 30 in one example. The control unit 18 controls the transportation amount of the continuous form paper P based on the image received from the imaging unit 30, using a well-known method.

In the feeding portion 14, a feeding shaft 14*a* extends in a width direction X of the continuous form paper P (direction orthogonal to a surface of a paper, in FIG. 1A). The width direction X is orthogonal to the transportation direction Y of the continuous form paper P. The feeding shaft 14*a* is mounted so as to be capable of being rotationally driven. The continuous form paper P is supported by the feeding shaft 14*a* so as to be capable of being rotationally driven together with the feeding shaft 14*a* in a state of being wound in a roll shape in advance. When the feeding shaft 14*a* is rotationally driven, the continuous form paper P is fed toward the downstream side of the transportation path thereof from the feeding shaft 14*a*.

Figure 1B:
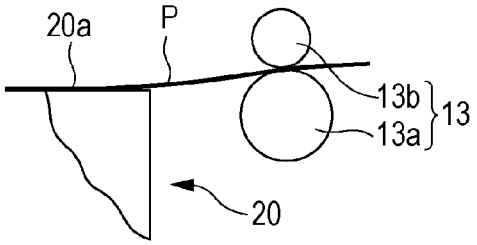
FIG. 1B is an enlarged view of paper feeding rollers and peripheries thereof shown in FIG. 1A.

In the diagonally downward left direction from the feeding shaft 14*a*, a pair of paper feeding rollers 13 is disposed. The pair of paper feeding rollers 13 is an example of the transportation unit which guides the continuous form paper P being transported from the feeding shaft 14*a* to the supporting surface 20*a* while being pinched by the pair of paper feeding rollers 13. The pair of paper feeding rollers 13 is disposed at a position in the transportation direction Y adjacent to the upstream side end portion of the medium supporting unit 20 in the transportation direction Y. The pair of paper feeding rollers 13 includes the paper feeding roller 13*a* which is mounted so as to be capable of being rotationally rotated and a paper pressing roller 13*b* which is driven in accordance with the rotation of the paper feeding roller 13*a*. As illustrated in FIG. 1B, a position where the continuous form paper P is pinched by the paper feeding roller 13*a* and the paper pressing roller 13*b* is positioned on a side higher than the supporting surface 20*a* of the medium supporting unit 20.

As illustrated in FIG. 1A, a tension roller 16 for adjusting the tension of a printed region of the continuous form paper P is disposed on the downstream side in the transportation direction Y of the supporting surface 20*a* in the transportation path of the continuous form paper P. The winding portion 15 is disposed on the downstream side of the tension roller 16 in the transportation path of continuous form paper P.

A winding shaft 15*a* which extends in the width direction X of the continuous form paper P is mounted on the winding portion 15 so as to be capable of being rotationally driven. The printed continuous form paper P being transported from the tension roller 16 side is sequentially wound around the winding shaft 15*a* by rotationally driving the winding shaft 15*a*.

Figure 2A:
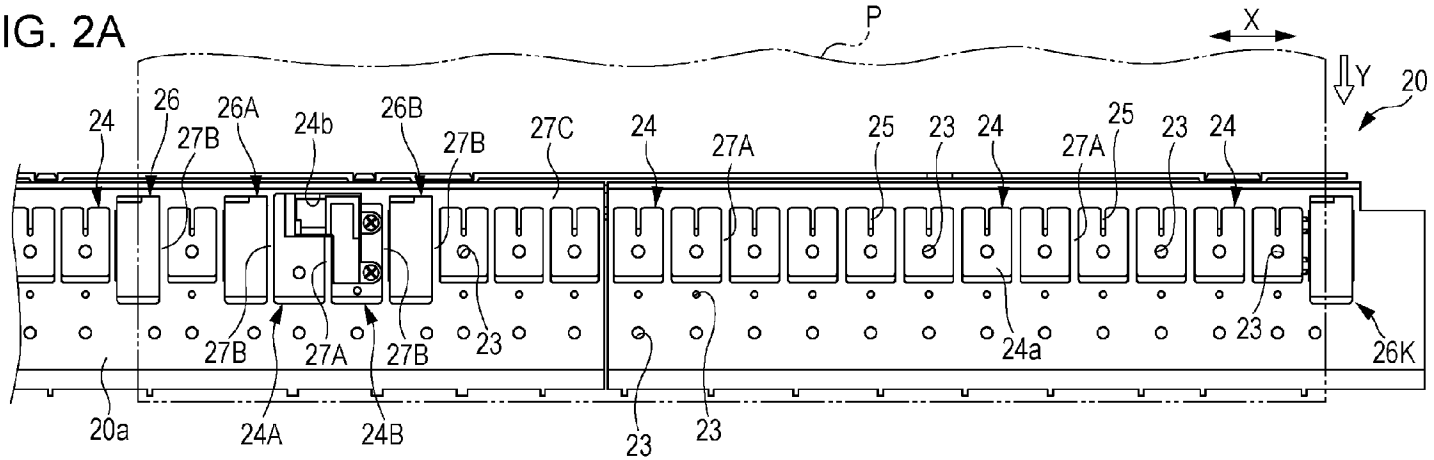
FIG. 2A is a plan view of a part of a medium supporting unit.

Next, a configuration of the medium supporting unit 20 will be described in detail with reference to FIGS. 2A to 3. As illustrated in FIG. 2A, a plurality of first recess portions 24 which open to the ejecting unit 17 (refer to FIG. 1A) side and are recessed downward from the supporting surface 20*a* are formed in the medium supporting unit 20. A plurality of second recess portions 26 which are recessed in the same manner as the first recess portion 24 but have a shape different from the first recess portion 24 are formed in the medium supporting unit 20. Each of the upstream side end portions in the transportation direction Y of the plurality of first recess portions 24 and each of the plurality of second recess portions 26 is formed on the upstream side end portion of the medium supporting unit 20 in the transportation direction Y.

The plurality of first recess portions 24 and the plurality of second recess portions 26 are formed on or in a print region where the ejecting unit 17 ejects ink onto the continuous form paper P in the medium supporting unit 20. The plurality of first recess portions 24 are formed in a row in the width direction X with predetermined intervals. Meanwhile, the plurality of second recess portions 26 are respectively formed on areas with different distances in the width direction X from one second recess portion 26 (hereinafter, also referred as to a "second recess portion 26K") formed on one end (right end in FIG. 2A). The second recess portion 26K serves as a standard in accordance with individual lengths in the width direction X of various types of the continuous form papers P to be used in the printer 11. In the width direction X, the first recess portions 24 are formed on both sides of each of the second recess portions 26 except the second recess portion 26K.

In addition, a supporting wall 27A, which becomes a boundary between the first recess portions 24 adjacent to each other in the width direction X and which supports the continuous form paper P, is formed between the first recess portions 24 adjacent to each other in the width direction X. The supporting wall 27A has the transportation direction Y as a longitudinal direction, and forms a part of a peripheral wall constituting the first recess portion 24. A supporting wall 27B, which constitutes a boundary between the first recess portion 24 and the second recess portion 26 adjacent to each other in the width direction X and which supports the continuous form paper P, is formed between the first recess portion 24 and the second recess portion 26 adjacent to each other in the width direction X. The supporting wall 27B has the transportation direction Y as a longitudinal direction and constitutes a part of a peripheral wall of the first recess portion 24 and a part of a peripheral wall of the second recess portion 26. On the upstream side end portions of all of the first recess portions 24 and the second recess portions 26 in the transportation direction Y, a supporting wall 27C constituting the upstream side end portion of the medium supporting unit 20 in the transportation direction Y is formed. The supporting wall 27C has the width direction X as a longitudinal direction and constitutes a part of a peripheral wall of the first recess portion 24 and a part of a peripheral wall of the second recess portion 26. The upper surface of the supporting wall 27A, the upper surface of the supporting wall 27B, and the upper surface of the supporting wall 27C constitute a part of the supporting surface 20*a* of the medium supporting unit 20.

In the first recess portion 24, a rib 25 is formed extending toward the downstream side in the transportation direction Y. The rib 25 is formed to be standing toward the ejecting unit 17 side from a bottom surface 24*a* of the first recess portion 24. A height from the bottom surface 24*a* of the first recess portion 24 to the upper surface of the rib 25 is similar to a height from the bottom surface 24*a* of the first recess portion 24 to the supporting surface 20*a*. In this regard, the upper surface of the rib 25 constitutes a part of the supporting surface 20*a*. The rib 25, in the transportation direction Y, extends from the upstream side end portion toward the downstream side of the first recess portion 24 in the transportation direction Y. The downstream side end portion of the rib 25 is positioned further on the upstream side than the center portion of the first recess portion 24 in the transportation direction Y. In addition, in the first recess portion 24, the suction hole 23 is formed further on the downstream side than the rib 25 in the transportation direction Y. For this reason, the first recess portion 24 communicates with the inner space 22 of the medium supporting unit 20 (refer to FIG. 1A) through the suction hole 23.

Figure 2B:
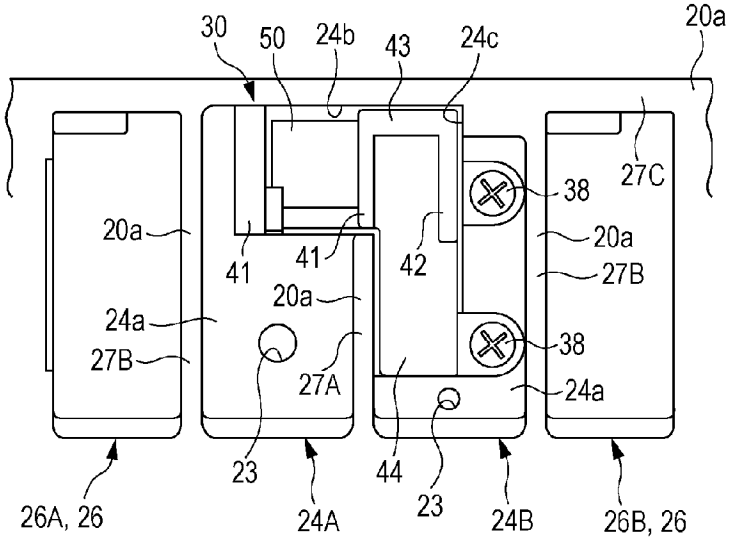
FIG. 2B is an enlarged view of a first recess portion and a second recess portion shown in FIG. 2A.

As illustrated in FIG. 2B, an opening 24*b* is formed on a region close to the upstream side in the transportation direction Y in two first recess portions 24 that are adjacent to each other. These first recess portions 24 are located between two second recess portions 26 in the width direction X. In the opening portion 24*b*, a part of the imaging unit 30 is inserted from below the supporting surface 20*a*. That is, the imaging unit 30 images the rear surface (the surface opposite the surface of the form paper P that receives the ink ejected by the ejecting unit) of the continuous form paper P through the opening portion 24*b*.

In the more detail, in the first recess portions 24, the two first recess portions 24 in which the opening portion 24*b* is formed are respectively referred to as a "first recess portion 24A" and a "first recess portion 24B". The first recess portions 24A and 24B have a length of the transportation direction Y which is greater than a length of the transportation direction Y of the other first recess portion 24.

Meanwhile, the second recess portion 26 has an opening shape capable of accommodating ink which is ejected onto the continuous form paper P from the ejecting unit 17 (refer to FIG. 1A). The second recess portion 26 has a length in the width direction X slightly smaller than that of the width direction X of the first recess portion 24. The second recess portion 26 includes an opening having a size in the transportation direction Y greater than that of the transportation direction Y of the first recess portion 24 except the first recess portions 24A and 24B. In the details as follows, the second recess portion 26 which is adjacent to the first recess portion 24A in the width direction X is referred to as a "second recess portion 26A", and the second recess portion 26 which is adjacent to the first recess portion 24B in the width direction X is referred to as a "second recess portion 26B".

Next, a configuration of the imaging unit 30 will be described in detail with reference to FIGS. 3 to 5. In FIGS. 3 to 4, an antistatic film 61 and an antifouling film 62 formed on the light-transmitting glass 50 (also, refer to FIG. 6) will not be described.

Figure 3:
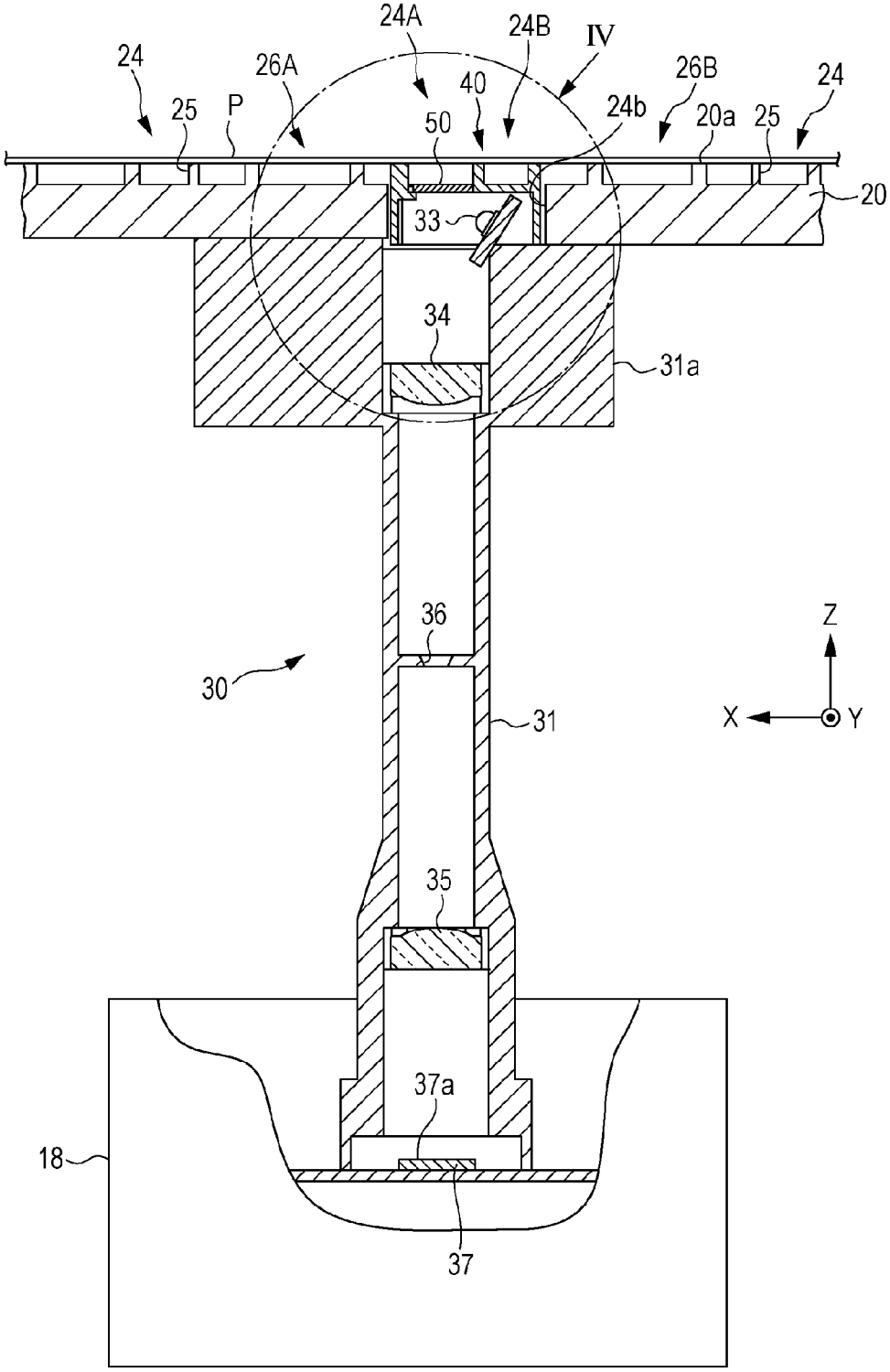
FIG. 3 is a cross-sectional view taken along line III-III in FIG. 1A.
Figure 4:
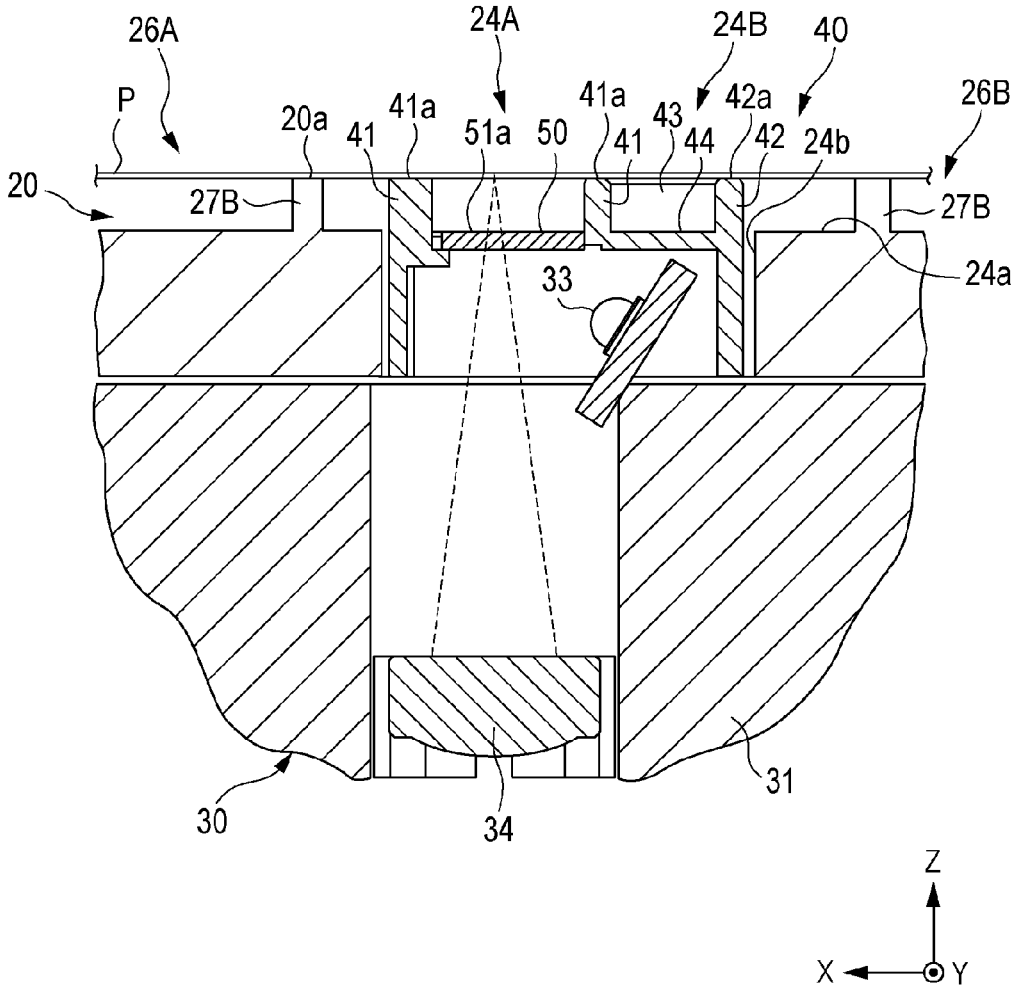
FIG. 4 is an enlarged view of a circle IV illustrated by an alternating long and short dashed line in FIG. 3.

As illustrated in FIG. 3, the imaging unit 30 includes a lens tube 31 extending in a vertical direction Z in a cylindrical shape. The lens tube 31 is fixed to the medium supporting unit 20 by a screw 38 (refer to FIG. 2B) or other suitable attachment mechanism in the upper end portion thereof, and is fixed to the control unit 18 including a housing by a screw (not illustrated) in the lower end portion thereof or by any other suitable attachment mechanism.

An accommodating unit 31*a* is formed on the upper end portion of the lens tube 31. An accommodating space inside the accommodating unit 31*a* extends in the transportation direction Y. The accommodating unit 31*a* includes a case body in which the top opens. A lens tube cover 40 is mounted on the opening of the accommodating unit so as to block accommodating space from above. The upper end portion of the lens tube cover 40 is inserted into the opening 24*b* of the first recess portions 24A and 24B. A colorless and transparent light-transmitting glass 50, which is an example of the light transmitting member, allows light to pass therethrough and into the accommodating space. The colorless and transparent light-transmitting glass 50 is fixed to the upper portion of the lens tube cover 40. The light-transmitting glass 50 blocks or is accommodated in the opening portion 24*b*.

A light radiation unit 33 for irradiating light onto rear surface of the continuous form paper P is disposed in the accommodation space formed by the accommodating unit 31*a* and the lens tube cover 40. An example of the light radiation unit 33 includes a light emitting diode (LED). The light radiation unit 33 is disposed so that light from the width direction X side is diagonally applied to the rear surface of the continuous form paper P. In one example, the light radiation unit 33 is offset from the light-transmitting portion in the X direction. The light radiation unit 33 irradiates the continuous form paper P with light from the rear surface side of the continuous form paper P being transported onto the supporting surface 20*a* through the light-transmitting glass 50.

The lens tube 31 accommodates an object side lens 34 positioned on the upper side (the medium supporting unit 20 side). The lens tube 31 also accommodates an image side lens 35 positioned on the side (control unit 18 side) lower than the object side lens 34. In addition, a diaphragm 36 is formed in between the object side lens 34 and the image side lens 35.

After the light radiated from the light radiation unit 33 is transmitted through the light-transmitting glass 50 and the light is reflected on or by the rear surface of the continuous form paper P, the object side lens 34 focuses the reflected light, which has been transmitted through the light-transmitting glass 50 again, into the lens tube 31. Thus, the reflected light enters into the lens tube 31. An example of the object side lens 34 includes a telecentric lens. The image side lens 35 focuses the light transmitted through the diaphragm 36. An example of the image side lens 35 includes a telecentric lens. The diaphragm 36 has a function of reducing a range of or amount of the light that reaches the object side lens 35, by passing the light which passes through the object side lens 34.

An imaging element 37 includes an imaging surface 37*a*, on which the light is focused by the image side lens 35 and on which an image of the texture of the rear surface of the continuous form paper P is formed, is disposed in the lower end portion of the lens tube 31. The lower end portion of the lens tube 31 may be accommodated in the control unit 18. An example of the imaging element 37 includes a two dimensional image sensor. An image of the rear surface of the continuous form paper P which is captured by the imaging unit 30 is output to a control circuit (not illustrated) in the control unit 18 that controls the transportation device 12.

As illustrated in FIG. 4, the lens tube cover 40 is provided with a pair of first supporting walls 41 as an example of the supporting wall supporting the light-transmitting glass 50, a second supporting wall 42 which is formed with an interval in the width direction X with respect to the pair of supporting walls 41, and a third supporting wall 43 which is a side wall connecting the first supporting wall 41 to the second supporting wall 42. In addition, in the lens tube cover 40, a fourth supporting wall 44 is formed at a position or location that corresponds the light radiation unit 33, in the width direction X. The fourth supporting wall 44 connects the lower portions of the first supporting wall 41 and the second supporting wall 42 to each other, and constitutes a part of an upper wall in the lens tube cover 40.

Figure 5:
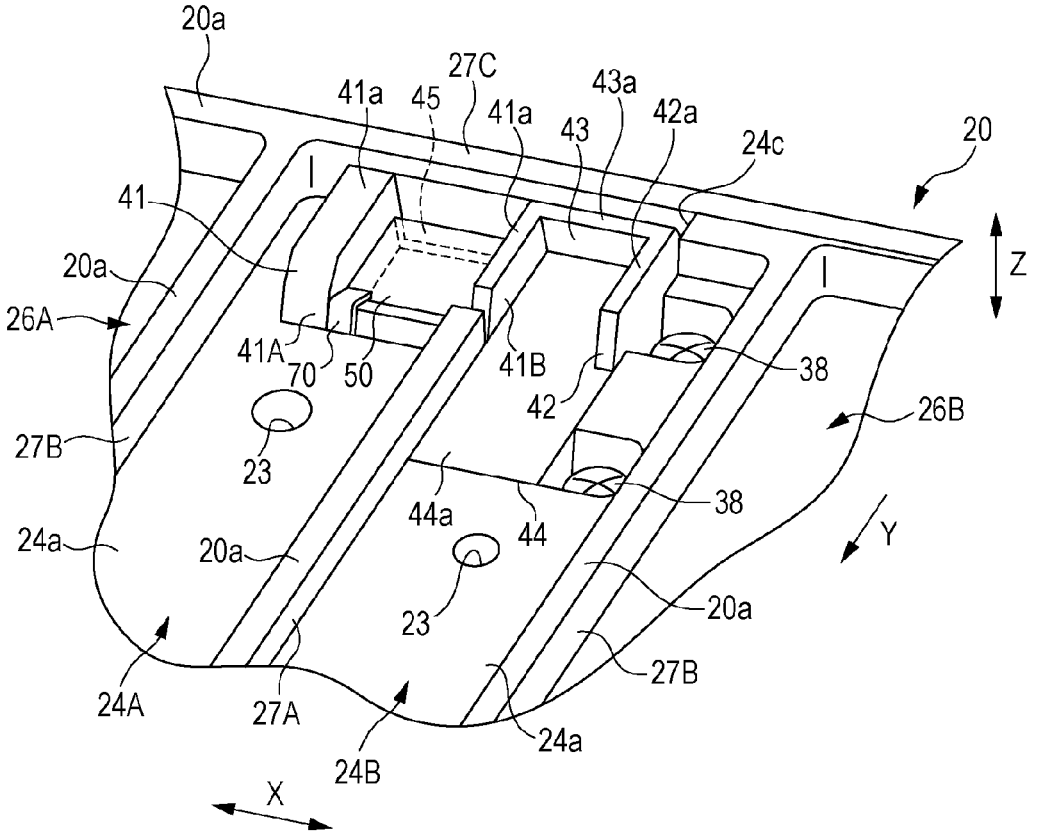
FIG. 5 is a perspective view of the first recess portion and peripheries thereof.

As illustrated in FIG. 4 and FIG. 5, respectively, upper surfaces 41*a* which are the upper end surfaces of the pair of first supporting walls 41, upper surfaces 42*a* which are the upper end surfaces of the second supporting walls 42, and upper surfaces 43*a* which are the upper end surfaces of the third supporting walls 43 are formed to have a height that is the same as that of the supporting surface 20*a* of the medium supporting unit 20 in the vertical direction Z. That is, the length (height Z1) from the bottom surface 24*a* of the first recess portion 24A to the upper surfaces 41*a*, 42*a*, and 43*a* in the vertical direction Z is similar to a length (height Z2) from the bottom surface 24*a* of the first recess portion 24A to the supporting surface 20*a* in the vertical direction Z. For this reason, the upper surfaces 41*a*, 42*a* and 43*a* support the continuous form paper P when the continuous form paper P is transported to the medium supporting unit 20. The upper surfaces 41*a*, 42*a*, and 43*a* have a function as the supporting surface and, in one example, form a part of the supporting surface. The pair of first supporting walls 41 protrude or extent to the upper side (supporting surface 20*a* side) further than the front surface 51*a* of the light-transmitting glass 50. Thus, the front surface 51*a* of the light-transmitting glass 50 is positioned apart from the lower side than the supporting surface 20*a*. In other words, the front surface 51*a* is apart from or separated from the ejecting unit 17 further than the supporting surface 20*a* (refer to FIGS. 1A and 1B) is separated from the ejecting unit 17.

The description, "the height Z1 from the bottom surface 24*a* of the first recess portion 24A to the upper surfaces 41*a* to 43*a* is similar to the height Z2 from the bottom surface 24*a* of the first recess portion 24A to the supporting surface 20*a*", means that a range is included in which the height Z1 and the height Z2 are slightly different from each other due to a machining error and an assembly error. In short, the height Z1 may be substantially the same as the height Z2.

As illustrated by a short dashed line in FIG. 4, in order for the imaging unit 30 to accurately image the rear surface of the continuous form paper P, a focal position of the object side lens 34 in the vertical direction Z is set to the supporting surface 20*a*. The focal position of the object side lens 34 is set to the side higher than the front surface 51*a* of the light-transmitting glass 50.

As illustrated in FIG. 5, the pair of first supporting walls 41 has the transportation direction Y as a longitudinal direction.

The supporting walls 41A and 41B which are the pair of first supporting walls 41 are formed to have an interval so that the light-transmitting glass 50 is interposed in the width direction X. The supporting walls 41A and 41B are configured to accommodate the light-transmitting glass 50 between them. Both end portions of the pair of first supporting walls 41 in the transportation direction Y include a void. Between the light-transmitting glass 50 and supporting wall 27C and between the pair of first supporting walls 41, an accommodating unit 45 is formed by the lens tube cover 40 and the supporting wall 27C. The accommodating unit 45 opens upward and is formed in a recess shape to be recessed downward from the front surface 51*a* of the light-transmitting glass 50.

The supporting wall 41A of the second recess portion 26A side in the pair of supporting walls 41 is positioned in the first recess portion 24A. The supporting wall 41A is positioned approximately on the center portion in the width direction X between the supporting wall 27B and the supporting wall 27A. The supporting wall 27B may be a boundary wall of the first recess portion 24A and the second recess portion 26A and the supporting wall 27A may be a boundary wall of the first recess portion 24A and the second recess portion 24B.

The supporting wall 41B of the second recess portion 26B side in the pair of supporting walls 41 constitutes a part of the supporting wall 27A, which is arranged as the boundary wall of the first recess portions 24A and 24B. The supporting wall 41B is configured as the upstream side end portion of the supporting wall 27A of the first recess portions 24A and 24B in the transportation direction Y.

The second supporting wall 42 has the transportation direction Y as a longitudinal direction. The second supporting wall 42 is positioned on the center portion in the width direction X between the supporting wall 27A as a boundary wall of the first recess portions 24A and 24B, and the supporting wall 27B as a boundary wall of the first recess portion 24B and the second recess portion 26B. The second supporting wall 42 is formed on the upstream end portion of the medium supporting unit 20 in the transportation direction Y.

The third supporting wall 43 is positioned in the first recess portion 24B. The third supporting wall 43 has the width direction X as a longitudinal direction. The third supporting wall 43 connects the upstream side end portion of the supporting wall 41B in the transportation direction Y to the upstream side end portion of the second supporting wall 42 in the transportation direction Y. On the upstream end portion in the transportation direction Y of the first recess portion 24 in which the third supporting wall 43 is disposed, a notch portion 24*c* is formed. The third supporting wall 43 is disposed at a position in the first recess portion 24 where the notch portion 24*c* is formed. In other words, the notch portion 24*c* accommodates the third supporting wall 43, which is disposed therein. In the notch portion 24*c*, the third supporting wall 43 constitutes a part of the supporting wall 27C.

The fourth supporting wall 44 on a part of the upper wall of the lens tube cover 40 is formed as a surface which is parallel to a plane surface formed by the width direction X and the transportation direction Y. The upper surface 44*a* of the fourth supporting wall 44 is flush with the bottom surface 24*a* of the first recess portion 24B. The fourth supporting wall 44 covers a part of the opening portion 24*b* from above.

The suction hole 23 formed on or in the first recess portion 24A is formed at a position where airflow can be generated along or over the front surface 51*a* of the light-transmitting glass 50 in response to the driving of the suction fan 28 in the medium supporting unit 20. More specifically, the suction hole 23 formed on or in the first recess portion 24A, in the pair of supporting walls 41 and the supporting wall 27C which are formed on a periphery of the light-transmitting glass 50, is formed on an extension of a part opening toward the downstream side end portion in the transportation direction Y. The suction hole 23 formed on the first recess portion 24A is positioned between the pair of supporting walls 41 in the width direction X, and is positioned on the downstream side lower than the light-transmitting glass 50 in the transportation direction Y. The suction hole 23 formed on or in the first recess portion 24A is positioned on the upstream side in the transportation direction Y further than the suction hole 23 of the first recess portion 24B. The light-transmitting glass 50 may be above, even with, or below the suction hole 23 in the vertical direction Z.

The suction hole 23 formed on the first recess portion 24B is positioned approximately on the center portion of the first recess portion 24B in the width direction X, and is positioned on the downstream side further than the fourth supporting wall 44 of the lens tube cover 40 in the transportation direction Y.

Next, a configuration of the light-transmitting glass 50 will be described with reference to FIG. 6.

Figure 6:
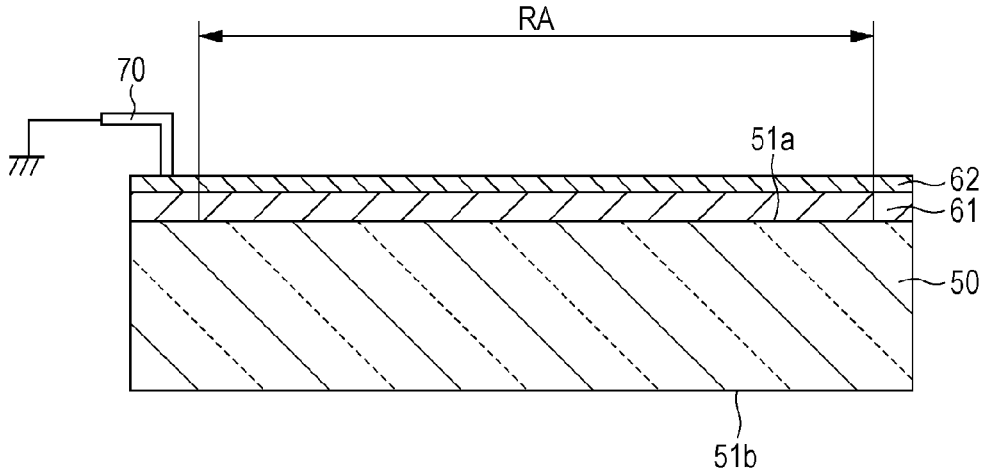
FIG. 6 is a cross-sectional view of an example of a light-transmitting glass, an antistatic film, and an antifouling film.

As illustrated in FIG. 6, an antistatic film 61 is formed on the front surface 51*a* of the light-transmitting glass 50. An antifouling film 62 is formed on the upper side of the antistatic film 61. The front surface 51*a* corresponds to a "first surface", and the rear surface 51*b* which is a surface opposite to or that opposes the front surface 51*a* corresponds to a "second surface".

As an example of the antistatic film 61, a compound obtained by adding a several percentage of tin oxide to indium oxide can be used. The antistatic film 61 is formed on the front surface 51*a* by a sputtering method, an ion plating method, or a vacuum evaporation method. The antistatic film 61, for example, may be formed on the entire surface of the front surface 51*a* of the light-transmitting glass 50. That is, the antistatic film 61 is formed on the predetermined region including the entirety of the irradiation region RA, which is irradiated with the light from the light radiation unit 33 (refer to FIG. 4), in the front surface 51*a* of the light-transmitting glass 50. Between the antistatic film 61 and the front surface 51*a*, an antireflection film (AR coat) is formed. The antireflection film (not illustrated) reduces the reflection of the light in the front surface 51*a*.

As an example of the antifouling film 62, a fluorine compound can be used. The antifouling film 62 prevents water or water stains from forming on the antireflection film.

The light-transmitting glass 50 is grounded by mounting or connecting the conductive member 70 to the predetermined region. As an example of the conductive member 70, the copper wire can be used. The conductive member 70 may also be connected to the medium supporting unit 20 in one example or to another suitable ground.

An operation of the printer 11 will be described with reference to FIG. 1A, FIG. 1B, FIG. 6, and FIG. 7.

On the inside of the printer 11, for example, on the medium supporting unit 20 and the peripheries thereof, foreign matter such as paper powder which is powder-form fiber peeled off from a front surface of the continuous form paper P, and dust may be present. For this reason, when the light-transmitting glass 50 is electrical-charged, the foreign matter may be drawn to the front surface 51*a* of the light-transmitting glass 50 by electrostatic induction.

As illustrated in FIG. 6, the antistatic film 61 is formed on the front surface 51*a* of the light-transmitting glass 50, and the light-transmitting glass 50 is grounded by mounting or connecting the conductive member 70 on the predetermined region. For this reason, the foreign matter such as the paper powder and dust are not easily drawn to the front surface 51*a* of the light-transmitting glass 50 by electrostatic induction. Accordingly, the foreign matter is not easily attached to the front surface 51*a* of the light-transmitting glass 50 by electrostatic induction. In a case in which the foreign matter is attached to the front surface 51*a* of the light-transmitting glass 50 due to electrostatic induction or for reasons other than electrostatic induction, the foreign matter on the front surface 51*a* may be removed by the following methods.

Figure 7:
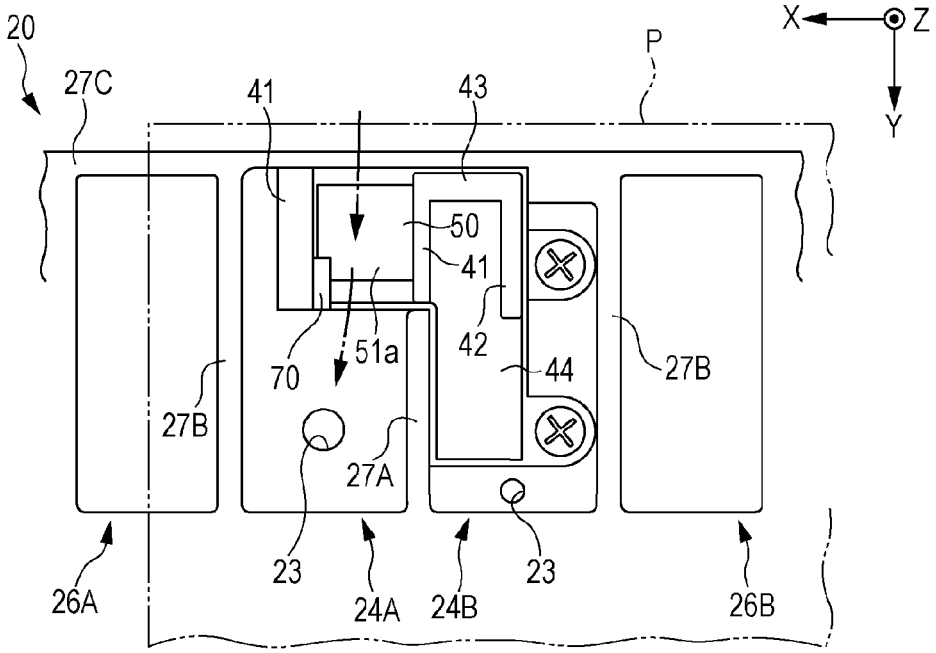
FIG. 7 is a plan view of a part of the medium supporting unit.

As illustrated in FIG. 7, when the continuous form paper P passes over the suction hole 23 formed on the first recess portion 24A, the suction fan 28 (refer to FIG. 1A) sucks the continuous form paper P. For this reason, air is introduced into a space formed between the continuous form paper P and the first recess portion 24. In the space between the continuous form paper P and the first recess portion 24, airflow is generated from the upstream side to the downstream side in the transportation direction Y. As illustrated by an arrow of an alternating long and short dashed line in FIG. 7, the airflow is guided onto the front surface 51*a* of the light-transmitting glass 50 by the pair of first supporting walls 41 of the lens tube cover 40. Accordingly, the airflow passes over the front surface 51*a* of the light-transmitting glass 50. The airflow that passes over the front surface 51*a* of the light-transmitting glass 50 passes through a part which is formed by the pair of first supporting walls 41 and the supporting wall 27C and opens to the transportation direction Y. Because the foreign matter attached to the front surface 51*a* of the light-transmitting glass 50 are moved to the downstream side in the transportation direction Y by the airflow, the foreign matter is removed from the front surface 51*a* of the light-transmitting glass 50. Most of the foreign matter removed from the front surface 51*a* of the light-transmitting glass 50 enters the suction hole 23.

According to the printer 11 of the present embodiment, effects to be described below can be obtained.

(1) Because the antistatic film 61 is formed on the front surface 51*a* of the light-transmitting glass 50, foreign matter such as paper powder and dust are not easily drawn to the front surface 51*a* of the light-transmitting glass 50 by electrostatic induction. Accordingly, the foreign matter is not easily attached to the front surface 51*a* of the light-transmitting glass 50. For this reason, it is possible to suppress a deterioration of the imaging accuracy of the continuous form paper P by the imaging unit 30.

(2) In a configuration of imaging the continuous form paper P from below, because the light-transmitting glass 50 is disposed under the continuous form paper P, foreign matter may fall down to the front surface 51*a* of the light-transmitting glass 50. In a case in which the foreign matter is attached to the front surface 51*a* of the light-transmitting glass 50 for reasons other than electrostatic induction, the foreign matter on the front surface 51*a* of the light-transmitting glass 50 is removed by the airflow generated from the suction fan 28. Because the foreign matter on the front surface 51*a* of the light-transmitting glass 50 does not easily exist or remain on the front surface 51*a*, it is possible to suppress a deterioration of the imaging accuracy of the continuous form paper P by the imaging unit 30.

(3) The light-transmitting glass 50 is grounded by the conductive member 70 mounted to the predetermined region, thereby an electrical charging of the irradiation region RA in the light-transmitting glass 50 is further suppressed. For this reason, it is possible to further suppress a deterioration of the imaging accuracy of the continuous form paper P by the imaging unit 30.

(4) The continuous form paper P transported by the pair of paper feeding rollers 13 is supported by the supporting walls 27A, 27B, 27C, 41, 42, 43, and 44. Meanwhile, the front surface 51*a* of the light-transmitting glass 50 is positioned to be apart from or separated from the ejecting unit 17 further than the supporting surface 20*a* is separated from the ejecting unit 17. For this reason, the rear surface of the continuous form paper P does not easily come into direct contact with the front surface 51*a* of the light-transmitting glass 50. Accordingly, the light-transmitting glass 50 is not easily charged by friction.

(5) The foreign matter existing on the front surface 51*a* of the light-transmitting glass 50 is delivered to the outside, by the airflow generated by the suction fan 28, from a space surrounded by the pair of first supporting walls 41 and the supporting wall 27C through a part which opens in the downstream side end portion of the supporting walls 41A, 41B, and 27C in the transportation direction Y. The suction hole 23 is formed on an extension of the opening part, thereby making it easy to move the foreign matter delivered from the space surrounded by the supporting walls 41A, 41B, and 27C to the outside and into the suction hole 23 and to the outside of the apparatus in one example. In one example, the upstream sides of the supporting walls 41A and 41B are connected by the supporting wall 27C. The downstream sides of the supporting walls 41A and 41B are not connected by a supporting wall and are open. For this reason, the foreign matter is easily removed from the front surface 51*a* of the light-transmitting glass 50.

(6) The opening part is formed on or between the pair of first supporting walls 41 because a wall connecting to an end portion of the pair of first supporting walls 41 in the transportation direction Y is not formed along the width direction X. In the configuration, by a user cleaning the front surface 51*a* of the light-transmitting glass 50 with a cleaning tool such as a brush and a cotton tip, the foreign matter such as paper powder attached on the front surface 51*a* of the light-transmitting glass 50 can be removed from the upstream side and the downstream side in the transportation direction Y further than the light-transmitting glass 50. For this reason, the light-transmitting glass 50 is easily cleaned.

The above-described present embodiment may be changed to another embodiment which will be described hereinafter.

In the above-described embodiment, the antistatic film 61 can be formed on the rear surface 51*b* of the light-transmitting glass 50.

Out of the first surface and the second surface of the light-transmitting glass 50, the front surface 51*a* which is the surface facing the continuous form paper P is determined when a manufacturer imposes or installs the light-transmitting glass 50 on or in the medium supporting unit 20. In one embodiment of the printer 11, because the antistatic film 61 is formed on both of the first and second surfaces of the light-transmitting glass 50, the manufacturer can select either of the first and second surfaces of the light-transmitting glass 50 as the front surface 51*a* when imposing or installing the light-transmitting glass 50 on or in the medium supporting unit 20. For this reason, work efficiency can be increased when imposing or installing the light-transmitting glass 50 on or in the medium supporting unit 20.

In the above-described embodiment, the antistatic film 61 may be formed on the predetermined region including at least a part of the irradiation region RA in the front surface 51*a* of the light-transmitting glass 50.

In the above-described embodiment, the suction hole 23 formed in the first recess portion 24 may include two or more suction holes.

In the above-described embodiment, the antifouling film 62 may be omitted.

In the above-described embodiment, instead of the suction fan 28, or in addition to the suction fan 28, the front surface 51*a* of the light-transmitting glass 50 may be provided with the airflow generating unit sending gas such as air. The gas is caused to flow over the front surface such that, in one example, foreign matter is removed.

In the above-described embodiment, the lens tube cover 40 may constitute the entirety of the first recess portions 24A and 24B.

In the above-described embodiment, at least either of the pair of first supporting walls 41 may be formed integrally with the medium supporting unit 20.

In the above-described embodiment, at least either of the pair of first supporting walls 41 may be omitted.

In the above-described embodiment, the wall connecting to the end portion of the pair of first supporting walls 41 in the transportation direction Y may be formed along the width direction X. In this case, an opening is formed on the wall connecting to the end portion of the pair of first supporting walls 41 in the transportation direction Y along the width direction X.

In the above-described embodiment, the second supporting wall 42 of the lens tube cover 40 may form only a part of the rib 25.

In the above-described embodiment, the second supporting wall 42 of the lens tube cover 40 may be omitted.

In the above-described embodiment, the rib 25 formed on the first recess portion 24 may include two or more ribs. In this case, a plurality of ribs 25 is formed with an interval in the width direction X.

In the above-described embodiment, the rib 25 of the first recess portion 24 may be omitted.

In the above-described embodiment, a communication portion communicating with a space closer to the pair of paper feeding rollers 13 side than the medium supporting unit 20 and a space between the first recess portion 24A and the continuous form paper P may be formed on the supporting wall 27C constituting the first recess portion 24A. When the continuous form paper P is transported, air from the outside is introduced into the space between the first recess portion 24A and the continuous form paper P through the communication portion. For this reason, the airflow illustrated by arrows of an alternating long and short dashed line in FIG. 7 is easily generated.

In the above-described embodiment, the focal position of the object side lens 34 may be set within a range from the side higher than the front surface 51*a* of the light-transmitting glass 50, to the side lower than the supporting surface 20*a* of the medium supporting unit 20.

When the continuous form paper P is sucked downward by the suction hole 23 by the suction fan 28, the continuous form paper P is bent downward in the first recess portion 24A. The imaging unit 30 images the rear surface of the continuous form paper P on the first recess portion 24A, thereby imaging the continuous form paper P which is bent downward. According to another embodiment, the focal position of the object side lens 34 is set to the side lower than the supporting surface 20*a*, thereby making it possible to adjust the focus on the rear surface of the continuous form paper P which is bent downward. Therefore, it is possible to image more accurately the rear surface of the continuous form paper P.

The liquid ejecting apparatus may be used in a thermal jet printer, and also used in a solid ink jet printer.

The liquid ejecting apparatus may be used in a serial printer, and also used in a line printer and a page printer.

The medium is not limited to the continuous form paper, and films made of resin, metal foils, metal films, complex films made of resin and metal (laminate film), fabrics, non-woven fabrics, ceramic sheets, and the like may be used.

The ink discharged from the ejecting unit 17 in a form of a small amount of a liquid droplet has a tail drawn in a granular shape, a tear shape, or a string shape. As the liquid used herein, a material capable of being ejected from ejecting unit 17 may be used. For example, a material in a liquid phase may be used, or a material in a liquid type having high or low viscosity, sol, or gel water, and in addition, inorganic solvent, organic solvent, a solution, or liquid resin in flow-able type may be used. In addition to the liquid as an example of materials, a solvent obtained by dissolving, dispersing, or mixing solid particles such as pigment may be used. In a case in which the liquid is ink, the ink may be typical water based ink or oil based ink, and may also be various liquid compositions such as gel ink and hot melt ink.

What is claimed is:

1. A liquid ejecting apparatus comprising:

a transportation unit that transports a medium;

an ejecting unit that ejects liquid onto the medium which is transported by the transportation unit;

a medium supporting unit that includes a supporting surface capable of supporting the medium transported by the transportation unit so that the medium is opposite to the ejecting unit;

a light-transmitting member that is mounted at a position in the medium supporting unit where the light-transmitting member faces the medium transported by the transportation unit;

an imaging unit that captures an image of the medium which passes over a front surface of the light-transmitting member;

a control unit that controls a transportation amount of the medium by the transportation unit based on the image captured by the imaging unit; and an airflow generating unit that generates airflow onto the front surface of the light-transmitting member, wherein an antistatic film is formed on the front surface of the light-transmitting member.

2. The liquid ejecting apparatus according to claim 1, wherein the antistatic film is formed on a predetermined region including at least an irradiation region irradiated with light by the imaging unit on the front surface of the light-transmitting member, and wherein the light-transmitting member is grounded by connecting a conductive member to the predetermined region.

3. The liquid ejecting apparatus according to claim 1, wherein the light-transmitting member includes a first surface and a second surface opposite to the first surface, and either of the first surface and the second surface corresponds to the front surface, and wherein the antistatic films are formed on both of the first and second surfaces.

4. The liquid ejecting apparatus according to claim 1, wherein the front surface of the light-transmitting member is positioned further apart from the ejecting unit than the supporting surface.

5. The liquid ejecting apparatus according to of claim 1, wherein the medium supporting unit includes suction holes which are capable of sucking the medium supported by the supporting surface in response to driving of the airflow generating unit, and wherein the suction holes are formed at a position where the airflow is able to be generated along the front surface of the light-transmitting member in the medium supporting unit in response to the driving of the airflow generating unit.

* * * * *